US005485707A

United States Patent [19]

Wilkes

[11] Patent Number: 5,485,707

[45] Date of Patent: Jan. 23, 1996

[54] METHOD AND APPARATUS FOR RELIEVING HYDROSTATIC PRESSURE FROM UNDER A SWIMMING POOL

[76] Inventor: Kenneth Wilkes, 724 Van Auken St., Elmhurst, Ill. 60126

[21] Appl. No.: 260,060

[22] Filed: Jun. 15, 1994

[51] Int. Cl.[6] ..... E04B 1/00

[52] U.S. Cl. ..... 52/741.3; 52/169.7; 52/741.4; 405/52; 4/295; 4/507

[58] Field of Search ..... 4/494, 496, 507, 4/508, 295; 52/741.3, 741.4, 169.7; 405/52

[56] References Cited

U.S. PATENT DOCUMENTS

| | | | |
|---|---|---|---|
| 1,539,617 | 5/1925 | Williston | 137/514 |
| 3,059,243 | 10/1962 | Ross et al. | 52/169.9 X |
| 4,276,163 | 6/1981 | Gordon | 210/136 |
| 4,613,169 | 9/1986 | Englehart | 4/507 X |
| 4,620,330 | 11/1986 | Izzi | 4/295 X |
| 4,752,979 | 6/1988 | Goachet | 4/496 |
| 5,036,881 | 8/1991 | Southmayd | 139/533.29 |
| 5,115,554 | 5/1992 | Fell | 4/295 X |
| 5,209,257 | 5/1993 | Baker | 4/295 X |
| 5,224,514 | 7/1993 | Taylor | 4/295 X |
| 5,341,523 | 8/1994 | Barnes | 4/507 |

*Primary Examiner*—Carl D. Friedman
*Assistant Examiner*—Robert J. Canfield
*Attorney, Agent, or Firm*—Patnaude, Videbeck & Marsh

[57] ABSTRACT

A fitting for relieving hydrostatic pressure under a swimming pool includes a sleeve and an associated removable plug, both of which have planar upper surfaces. Fittings in accordance with the invention are installed in the shallow end of a swimming pool and the plug is manually removed to relieve hydrostatic pressure.

1 Claim, 3 Drawing Sheets

METHOD AND APPARATUS FOR RELIEVING HYDROSTATIC PRESSURE FROM UNDER A SWIMMING POOL

The present application relates to a method and apparatus for installing a relief plug for relieving hydrostatic pressure underneath a swimming pool, and in particular to a plug usable in the shallow end of a pool.

BACKGROUND OF THE INVENTION

In-ground swimming pools are typically drained and left empty during the winter months. On some occasions, however, hydrostatic pressure builds up under the pool, especially as a result of spring rains. On such occasions, it is desirable to relieve the hydrostatic pressure by allowing water into the pool. If the hydrostatic pressure is not relieved, and becomes excessive, the in-ground pool will be forced out of the ground altogether and totally destroyed.

Existing relief valves for swimming pools have a plug compressed into a seat by a spring. When hydrostatic pressure under the plug exceeds the pressure of the spring, the plug will be forced out of its seat, and water will enter the pool. The structure for supporting the spring used to push the plug into the seat is typically positioned above the surface of the swimming pool so that the structure can easily be cleaned and will not be clogged with dirt or other debris which would prevent operation of the relief valve. As a result, existing relief valves must be positioned at the deep end of the pool, typically near the drain in the center thereof. If such relief valves were positioned in the shallow end of a pool, the upwardly extending structure supporting the spring would injure the feet of swimmers.

Even though existing relief valves have readily visible spring mechanisms, such valves nonetheless become clogged and fail to operate. Since such valves are typically positioned at the bottom of a pool, they are often under water, and generally unaccessible. As a result, it is difficult to check such relief valves. In many cases, an inoperative relief valve is not detected, and damage is caused to the swimming pool.

Where hydrostatic pressure is strong enough to cause damage to a pool, the water level under the pool is high enough that pressure could also be relieved in the shallow end of the pool. It would be desirable, therefore, to provide a means for relieving hydrostatic pressure which can be installed in the shallow end of the pool and would be substantially flush with the surface of the pool so as not to injure swimmers.

SUMMARY OF THE INVENTION

Briefly, the present invention is a method and apparatus for providing a pressure relief fitting including a sleeve and an associated plug for insertion in an in-ground swimming pool. The sleeve has a substantially planar upper end and an axial inner opening. A sealing means is provided to seal the outer surface of the sleeve against the inner wall of a bore in the floor of the swimming pool. The plug has a substantially planar upper end is retained in the inner opening of the sleeve by any appropriate means such as threads. When the plug is inserted into the sleeve, the upper surface of the plug is substantially coplanar with the upper end of the sleeve and also substantially flush with the surrounding inner surface of the pool. Fittings in accordance with the present invention can be located in both the shallow end and the deep end of a pool. Hydrostatic pressure under the pool is relieved by removing one or more plugs from the associated sleeves.

Where the sleeve is inserted in a pool having a vinyl liner, the upper end of the sleeve is sealed against the vinyl liner by a washer threaded on the sleeve and a gasket fitted between the washer and the vinyl liner.

BRIEF DESCRIPTION OF THE DRAWINGS

A better understanding of the present invention will be had by reference to the following detailed description taken in conjunction with the accompanying drawings wherein.

DETAILED DESCRIPTION OF A PREFERRED EMBODIMENT OF THE INVENTION

Figure 1:
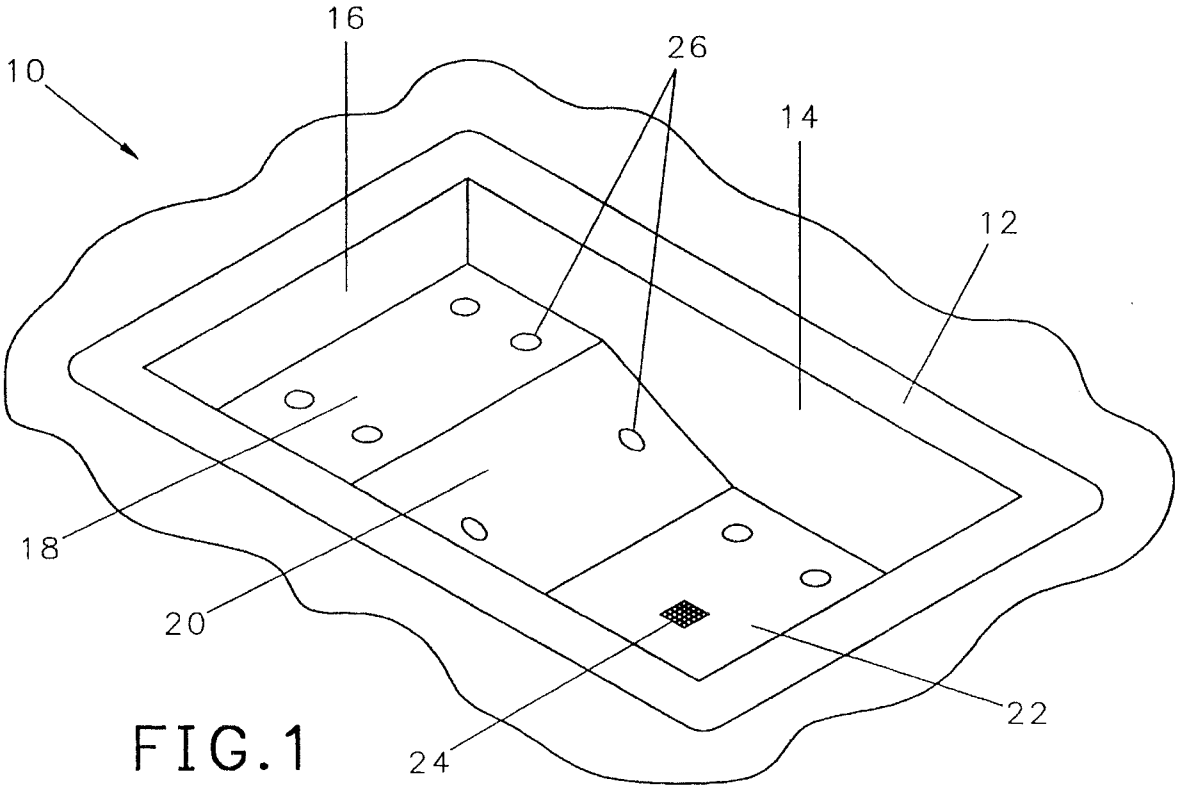
FIG. 1 is an isometric view of a swimming pool having a plurality of relief fitting in accordance with the present invention.

Referring to FIG. 1, an in-ground swimming pool 10 typically has a surrounding apron 12, complementary sides, one of which 14 is depicted, and two ends, one of which 16 is depicted. The pool has a shallow end 18 and a ramp portion 20 sloping downwardly to a deep end 22. In the center of the deep end 22 is a grate 24 for withdrawing water from the bottom of the pool.

The pool 10 is fitted with a plurality of relief fittings 26 some of which are positioned in the shallow end of the pool, others of which are positioned in the ramp 20 and the remainder are positioned in the deep end 22 of the pool 10.

Figure 2:
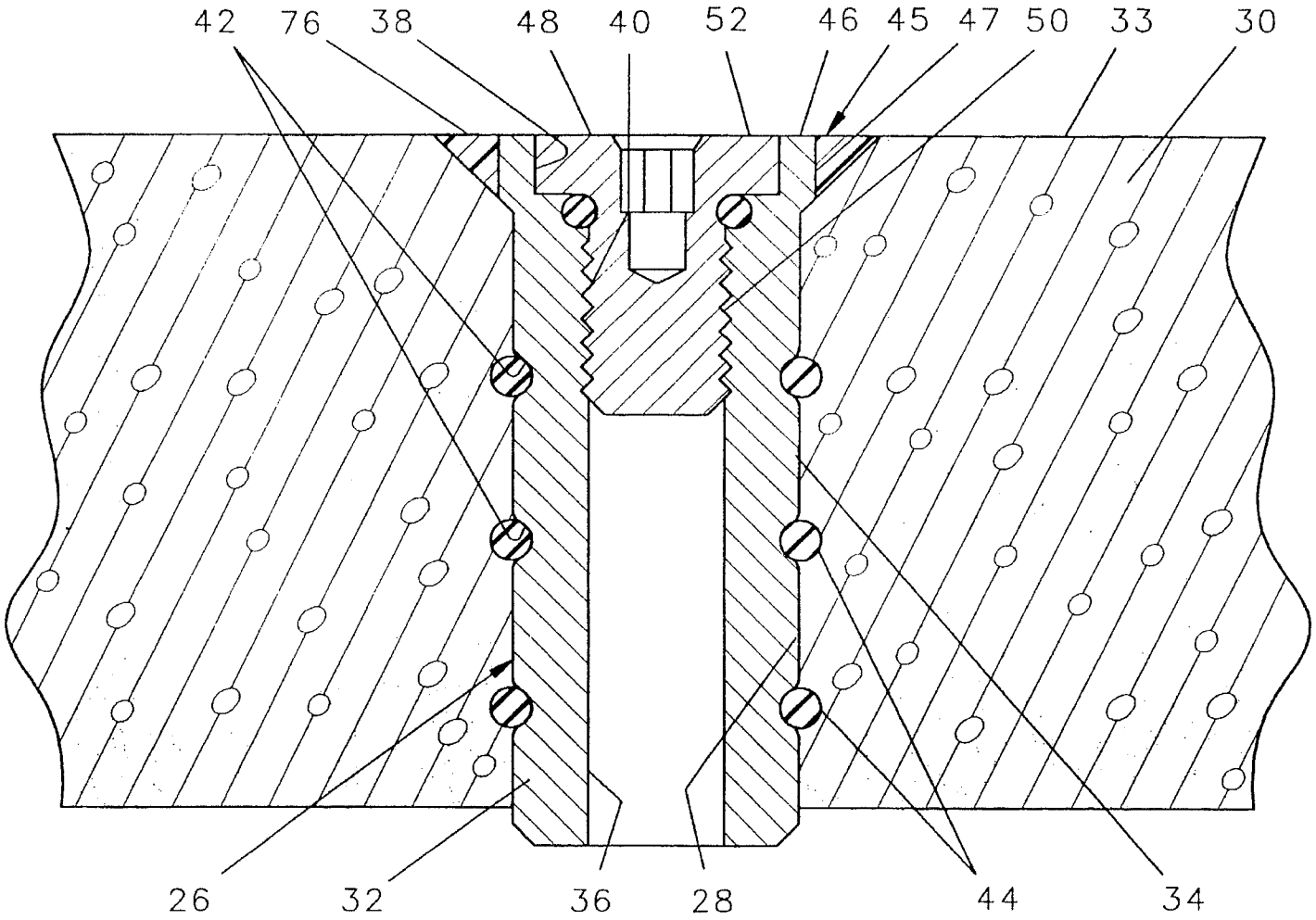
FIG. 2 is an enlarged cross-sectional view of a relief fitting inserted into a concrete swimming pool including a plug inserted in the sleeve.

Referring to FIG. 2, a relief fitting 26 is fitted into a bore 28 in the floor 30 of the pool 10. The floor 30 of the pool may be made of concrete or micalite and the bottom of the pool has a generally planar upper surface 33.

The fitting 26 has a tubular body or sleeve 32 with a generally cylindrical outer surface 34 and an axial opening 36 extending through the length thereof. The upper end of the axial opening 36 has a counterbore 38, and below the counterbore 38 is a threaded portion 40 which extends approximately one-third of the length of the sleeve 32.

Along the outer surface 34 of the sleeve are a plurality of spaced annular grooves 42, and each groove is adapted to receive an O-ring 44 for sealing the outer surface 34 of the fitting 26 against the concrete wall 30 of the swimming pool. The upper end of the sleeve 32 has an enlarged top portion 45 having a substantially planar upper surface 46, and a knurled outer surface 47.

Figure 3:
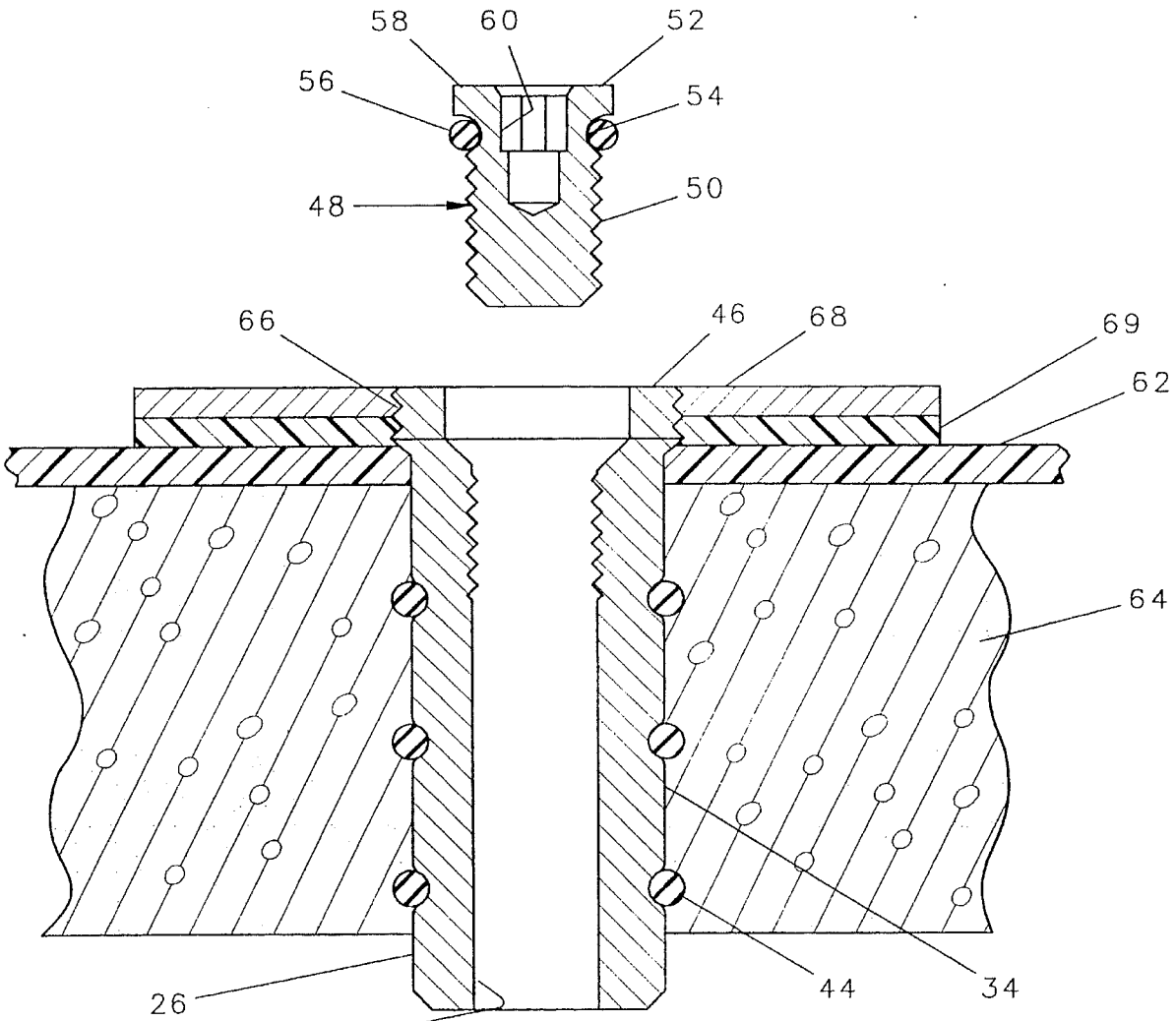
FIG. 3 is an enlarged cross-sectional view of a relief fitting inserted into a swimming pool having a vinyl liner with the plug retracted from the sleeve.

Referring to FIGS. 2 and 3, a plug 48 has a generally cylindrical body, the lower portion 50 of which has threads which are complementary to the threads in the upper portion 40 of the sleeve 32. The plug 48 further has an enlarged cylindrically shaped head 52 adapted to fit within the counterbore 38 of the sleeve 32 and between the threaded portion 50 and the head 52 is an annular groove 54 for receiving an O-ring 56. The upper surface 58 of the plug 48 is generally planar and centrally located in the upper surface is a polygon shaped axial hole 60 for receiving the end of a tool such as an allen wrench for rotating the plug 48 and thereby threading it into or out of the threaded portion 40 of the sleeve 32.

When the plug 48 is threaded into the sleeve 32, the O-ring 56 will seal the plug 48 against the inner bore 36 of the sleeve 32. Also, the upper surface 58 of the plug will be substantially co-planar with the planar upper surface 46 of the sleeve 32, and substantially co-planar or flush with the upper surface 33 of the pool. As a result, when the plug 48 is inserted into the sleeve 32, the fitting will be flush against the bottom of the pool and not interfere or cause injury to swimmers using the pool even when the fitting is inserted in the shallow end thereof.

Referring to FIG. 3, wherein like elements bear like indicia numbers, a fitting 26 may also be inserted into the bottom of a pool having a vinyl liner 62 which abuts against the upper surface of the concrete or micalite floor 64 of the pool.

In this embodiment, the upper end of the cylindrical outer surface 34 of the sleeve 32 has a threaded portion 66. A member such as a washer 68 having an internal threading which is complementary to the outer threads 66 of the sleeve 32 is threaded onto the upper end thereof and over an annular gasket 69 to seal the upper end of the sleeve 32 against the vinyl liner 62 of the pool.

Referring to FIG. 1, in accordance with the present invention, a plurality of fittings 26 are inserted in the bottom of a swimming pool, and some of the fittings 26 are inserted in the shallow end 18 of the pool. As a result, even when the pool is partially flooded and water is in the deep end, fittings in the shallow end of the pool are accessible.

Fittings in accordance with the present invention are not spring loaded so as to relieve hydrostatic pressure when the force exerted on the inside of the plug reaches a given threshold as is the case with existing relief valves. The fittings in accordance with the present invention must be manually removed during Spring, or such other times when rain or other conditions suggest that the underground water level near a pool will be high, resulting in a great amount of hydrostatic pressure under the pool.

Typically, the plugs 48 can be removed from the shallow end 18 of a swimming pool 10 with the melting of snow or rains of spring when the water level in the ground rises. When the plugs 48 are removed from the fittings 26, water will enter the pool through the axial opening 36 and run down the ramp 20 to the deep end 22 thereby counterbalancing the hydrostatic pressure under the deep end of the pool. Fittings in accordance with the present invention which are located in the shallow end of the pool are more accessible and can, therefore, be more readily serviced.

Figure 4:
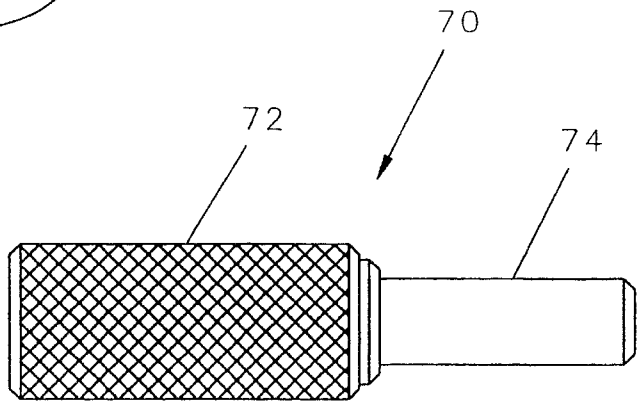
FIG. 4 is a tool for inserting a sleeve into the bottom of a pool.

Referring to FIG. 4, to insert a fitting 26 into the bottom of a swimming pool which does not have a vinyl liner, a technician must first bore a hole in the bottom of the pool and thereafter insert a sleeve 32. To insert a sleeve 32, a tool 70 having a cylindrical knurled handle 72 and a narrower coaxial cylindrical shaft 74 is provided. The exterior diameter of the shaft 74 is adapted to fit slidably within the axial opening 36 of the sleeve 32. Using the tool 70 and a hammer, the sleeve 32 can be forced into a bore in the bottom of a swimming pool until the upper surface 46 thereof is substantially coplanar to the upper surface 33 of the pool. As shown in FIG. 2, a hydrostatic cement or sealer 76 can be used to seal the outer surface 47 of the top portion 45 of the fitting 26 against the concrete or micalite of the bottom of the pool.

To insert the fitting 26 in the floor of a swimming pool having a vinyl liner, the same procedure is used as described above except that a gasket 68 is fitted over the upper end of the sleeve 26 and a washer 66 is threaded on the upper end of the sleeve 32 to seal the upper end of the sleeve 32 to the liner 62 instead of the hydrostatic cement 76 as described above.

It should be noted that fittings in accordance with the present invention can be inserted into the shallow end of a pool having a relief valve in accordance with the prior art. The fittings of such pools should be checked when the water level under the pool rises as described above, and the technician maintaining the pool should not rely upon the prior art valve to relive hydrostatic pressure.

There is, therefore, disclosed a method and apparatus whereby hydrostatic pressure can be relieved from a pool using fittings which have upper surfaces substantially coplanar with the upper surface of the bottom of a pool. Such fittings are readily accessible because they are usable in the shallow end of the pool and will not cause injury to swimmers.

While the present invention has been described in various specific embodiments, it will be appreciated by those skilled in the art that many changes may be made without departing from the true spirit and scope of the present invention. Therefore, it is intended by the appended claims to cover all such changes and modifications which come within the true spirit and scope of the invention.

What is claimed:

1. The method of relieving hydrostatic pressure under an in-ground swimming pool having a shallow end comprising the steps of boring a plurality of holes in the shallow end of a swimming pool, inserting into each of said borings a sleeve for receiving a removable plug, inserting said removable plug into said sleeve such that it is flush with an inner surface of said pool, and removing said removably plug when hydrostatic pressure is to be relieved.

* * * * *